United States Patent [19]

Fisher et al.

[11] Patent Number: 4,977,712

[45] Date of Patent: Dec. 18, 1990

[54] HAND SANDER

[76] Inventors: Charles P. Fisher, 161 Belknap Rd., Framingham Center, Mass. 01701; George M. Pahud, 62 Robinwood Ave., Needham, Mass. 02192

[21] Appl. No.: 367,850

[22] Filed: Jun. 16, 1989

[51] Int. Cl.[5] ..... B24D 17/00

[52] U.S. Cl. ..... 51/380; 51/379; 51/392

[58] Field of Search ..... 51/401, 407, 400, 380, 51/389, 390, 393, 205 R, 359, 360, 361, 367, 369, 391, 392, 399, 357, 358, 379; 15/231, 232, 233

[56] References Cited

U.S. PATENT DOCUMENTS

| | | | |
|---|---|---|---|
| 3,874,126 | 4/1975 | Catlin et al. | 51/393 |
| 4,242,843 | 1/1981 | Phillips | 51/380 |
| 4,263,755 | 4/1981 | Globus | 51/358 |
| 4,589,233 | 5/1986 | Parekh et al. | 51/399 |
| 4,712,552 | 12/1987 | Pangburn | 51/401 |
| 4,841,684 | 6/1989 | Hall, Jr. | 51/399 |

*Primary Examiner*—Frederick R. Schmidt
*Assistant Examiner*—Mark F. Frazier
*Attorney, Agent, or Firm*—Wolf, Greenfield & Sacks

[57] ABSTRACT

A hand tool for sanding, including a C-shaped frame securing a strip of abrasive material in which the strip is reinforced with strapping material laminated to its back and the ends of the strip are secured to the frame by a wedge means.

2 Claims, 2 Drawing Sheets

HAND SANDER

SUBJECT MATTER OF INVENTION

The present invention relates to a hand tool for sanding and to disposable abrasive strips for a hand tool.

BACKGROUND OF INVENTION

There are commercially available a variety of sanding tools that make use of a replaceable sanding element such as sandpaper strips. One type of hand sander comprises a holder having clamps which secure the ends of a piece of sandpaper or the like with the center portion of the sandpaper firmly supported against a backer. This sanding tool may be a hand held block, with spring clamps holding a rectangle of sandpaper, or may be provided with an electric vibrator which reciprocates the sandpaper at high speeds. Such tools are commonly used for sanding large surfaces or surfaces having a great deal of material to be removed or smoothed. Most tools are not ordinarily useful for small delicate sanding or sanding of small and unusually-shaped workpieces. In part, the limitations of such tools result from the inclusion in the tool of a backer used to support and engage the back of the sandpaper which does not have enough tensile strength to be self supporting.

A second type of hand tool sander is exemplified by U. S. Pat. Nos. 3,956,858 and 3,874,126. In general these patents secure a flexible strip of abrasive material in a hacksaw-like frame. This second type of hand tool sander which is not designed primarily for large surfaces but rather for a smaller component, nonetheless has limitations even for such uses. Such hand sanders exemplified, for example, by patents 3,956,858 and 3,874,126 require the use of specially-shaped and designed abrasive strips which appear to be comparatively expensive to make and therefore not desirable as a disposable item. Furthermore, such sanding strips may not provide sufficient flexibility and adaptability for tools of different sizes. The mechanism for securing the strip, moreover, is not useful for fabric or paper sanding strips and presents problems with respect to manufacture, assembly and use.

Additionally, the flexible abrasive sanding strips, which have been designed and used in connection with hand sanders of a type described in the second group, are not adapted for use on sanding small circumferences or curved surfaces. Finally, this is a hand tool intended to facilitate work on small or irregular pieces where power tools are difficult to control or otherwise inappropriate.

SUMMARY OF THE INVENTION

It is an object of the present invention to overcome the deficiencies of currently designed hand sanders by providing an improved sander which utilizes an abrasive strip secured at its ends to a C-shaped frame.

A further object of the present invention is to provide an improved locking mechanism for clamping abrasive strips to a C shaped frame.

One more object of the present invention is to provide adjustable clamping means for a C-shaped frame whereby tension on an abrasive strip secured by the clamp may be adjusted.

Another object of the present invention is to provide an improved hand tool that is adapted to be made in a variety of sizes including small configurations for use in abrading or sanding delicate components and for use in particular trades such as jewelers, gunsmiths or the like.

A further object of the present invention is to provide an improved hand tool clamping mechanism which is easy and inexpensive to make and which maximizes the working surface of the abrasive strip.

A further object of the present invention is to provide an improved clamping mechanism which is simple to use, adjust and tension.

One further object of the present invention is to provide an improved clamping mechanism with few moving parts that is easy to make and to use Another object of the present invention is to provide an inexpensive, durable, disposable flexible strip of abrasive material adapted to be supported only at its ends in a C-shaped frame.

One further object of the present invention is to provide an improved disposable sanding paper comprising a laminated strip having one abrasive surface reinforced by strapping tape or the like extending longitudinally in facing relationship to the surface opposite the abrasive surface of the strip.

Another object of the invention is to provide a tool having a flexible sanding surface for reciprocal movement over a workpiece while applying a force normal to the directions of reciprocal movement to effect sanding over either a nonplanar or planar surface of the workpiece.

One further object of this invention is to provide a tool that is particularly useful to jewelers for surface treatment of small workpieces.

DESCRIPTION OF DRAWINGS

These are other objects and advantages of the present invention will be more clearly understood when considered in conjunction with the accompanying drawings, in which.

DETAILED DESCRIPTION OF DRAWINGS

Figure 1:
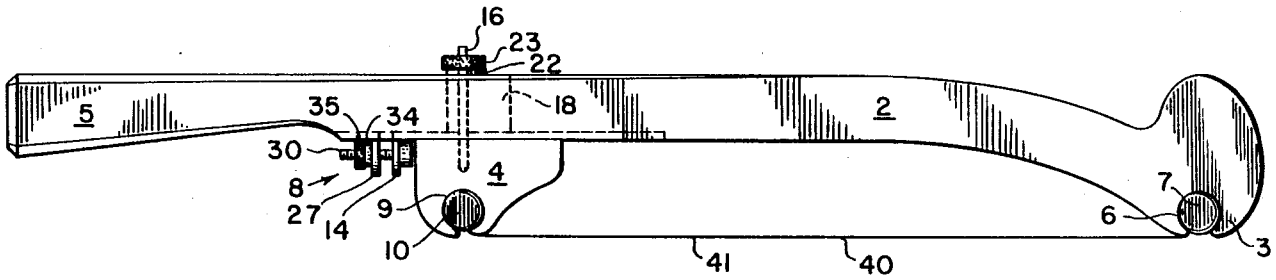
FIG. 1 is a side elevational view of a sanding tool embodying the invention.
Figure 2:
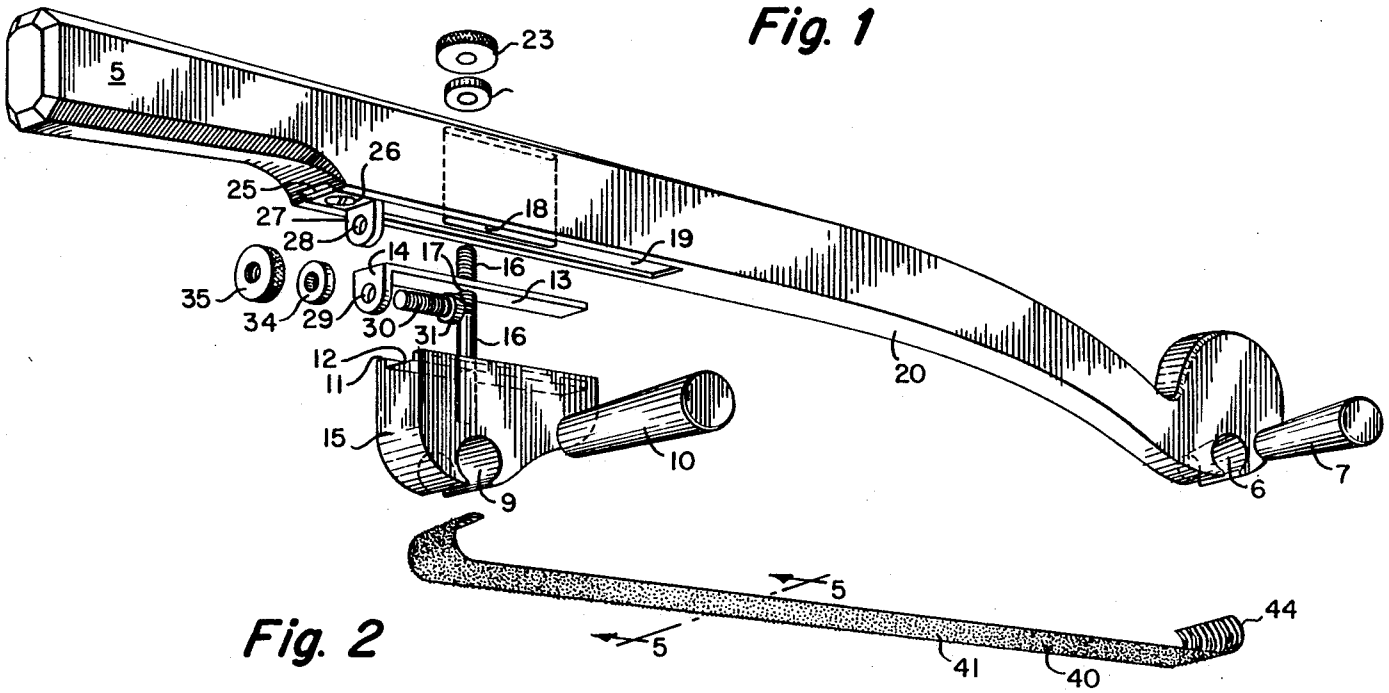
FIG. 2 is an exploded perspective view of the embodiment of FIG. 1.

As illustrated in FIGS. 1 and 2 the hand tool comprises a frame 2 having a pair of strip-engaging members 3 and 4 at spaced-apart locations of the frame. In the embodiment illustrated, these strip-engaging members project from the frame 2 along its length. The frame 2 is formed with a handle 5 at one end. Member 3 at the other end of the frame may be formed as an enlarged end having a hole 6 that extends from one side of the frame 2 to the other. The hole 6 is tapered to receive a tapered peg 7 in frictional engagement. The tapers of the hole 6 and peg 7 should match for tight and uniform fit as peg 7 is forced in the hole 6.

Member 4, unlike member 3, is not integral with the frame 2 but rather is secured to it by means 8 for selectively adjusting the distance between the members 3 and 4. The member 4 is formed with a tapered hole 9 similar in shape and dimensions to hole 6 to receive a tapered peg 10, which is similar in size and shape to tapered peg 7. Rather than being integrally formed with the frame 2, the member 4 has side 11 formed with a rabbet 12 extending longitudinally therein. An L shaped metal bracket 13 has one end fitted lengthwise within rabbet 12 and a leg 14 projecting downwardly and spaced from the forward wall 15 of member 4.

The member 4 and bracket 13 are secured rigidly together by a screw 16 which is suitably threaded from below through the member 4 and through a hole 17 in the bracket 13. The end of screw 16 extends upwardly through a slot 18 in the frame 2. The member 4 and bracket 13 fit and are longitudinally-slideable in the elongated slot 19 formed in the bottom side 20 of the frame 2. The forward and rear movement of the member 4 and bracket 13 is limited by the length of the slot 18 which may be any reasonable length desired. Preferably, the slot length should permit movement over a distance of about 1 to 3 inches when the distance between the holes 6 and 9 is at least eight inches.

The member 4 may be locked to the frame 2 at any selected position by tightening the knurled nut 23 against washer 22 on the screw 16, which projects through the slot 18.

Means are provided for adjusting tension on the member 4. This means includes an L-shaped bracket 24 having a leg 25 secured by screw 26 at the forward end of the slot 19. A downwardly extending leg 27 of the bracket is aligned with the leg 14 of bracket 13. The legs 14 and 27 are formed with aligned holes 28 and 29. A screw 30 having an enlarged head 31 extends through the aligned holes 28 and 29 with the head 31 adjacent forward wall 15 and the other end secured by washer 34 and nut 35.

An abrasive strip 40, described in greater detail hereafter, is formed as a laminate. This abrasive strip 40 has an abrasive surface 41. The abrasive strip is flexible and may have a variety of dimensions depending upon the particular sized tool for which it is intended. Typically, in full size hand tools, the strip 40 may be 8" to 15" long and ¼" to 2" wide. In a typical arrangement, the strip may be 2" wide and 11" long. It is preferable, however, that the width of the strip be no greater than the width of the members 3 and 4. In use, the ends 43 and 44 of the strip are curled, respectively, about pegs 10 and 7 and are wedged with the pegs into the holes 9 and 6, as illustrated in FIG. 1. The ends 43 and 44 should be sufficiently curled about the pegs 10 and 7 to provide the desired tension for the particular use for which the tool is then being used. It is not necessary to have the strip 40 taut at all times since there may be occasions in which it is desirable to have the strip 40 relatively loose to conform to an unusually shaped workpiece. Fine adjustments may thereafter be made by the adjusting means 8.

In the embodiments of FIGS. 1 and 2 and the other embodiments, the strip 40 is preferably formed of an elongated piece of conventional sandpaper reinforced by a standard reinforced adhesive tape and, in particular, the type of reinforced tape used to secure packaging or the like.

In addition to the use of conventional sandpaper as the abrasive surface, this invention also contemplates the use of similar abrasive materials such as wet or dry emery paper and the type of sandpaper generally referred to as production or open coat sandpaper. In any event, these abrasive sheets or strips are each reinforced with the reinforcing backing. The reinforcing backing, similar to the abrasive strip, is flexible, yet provides substantial tensile strength, which thereby increases the strength of the sandpaper and permits its use as such, without the conventional support that sandpaper ordinarily requires when used without such backing. While the present invention contemplates the preferred use of a paper sandpaper backed by what is commonly referred to as reinforced strapping tape because it is inexpensive, the frame 2 may also be used with fabric backed adhesive sandpaper which is commonly used for belt sanders.

Figure 5:
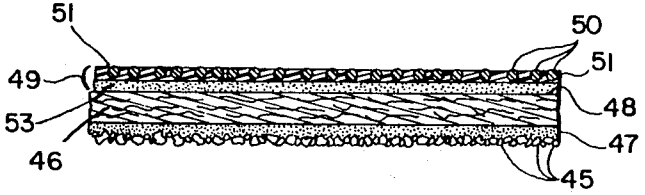
FIG. 5 is a schematic cross section taken along the line 5—5 of FIG. 2.

The construction of a typical abrasive strip is illustrated in FIG. 5. In this arrangement, the abrasive particles 45 are secured to a paper or paper-like flexible sheet 46 by a coating of adhesive or the like 47 in conventional fashion. In place of this arrangement of elements 45 through 47, a standard commercial sandpaper or emery paper may be used. Adhered to the back surface 48 of this abrasive strip is a second laminate of reinforcing material 49. This laminate of reinforcing material 49 may, as noted above, comprise a standard reinforcing strapping conventionally used in packaging or the like. The characteristics of the strapping 49, however, should be that it is flexible, provides significance longitudinal stability and tensile strength which exceeds significantly that of the sandpaper. Typically in such an arrangement the strapping comprises a plurality of filaments 50 having significant tensile strength. These filaments are spaced closely together and may, for example, be spaced a distance apart of 1/16" or more. The filaments 50 are conventionally adhered to a plastic or plastic like backer 51 by a cementitious matrix 53. In this arrangement the backer 51 is conventionally made of an extruded plastic as generally are the fibers or filaments 50. A conventional and chemically and mechanically compatible abrasive or cementitious matrix 53 secures the fibers 50 to the inner surface of the backing sheet 51 and further provides adherence to the surface 48 of the sandpaper sheet.

Referring once again to the embodiment of FIGS. 1 and 2, the element 4 is designed for orientation with respect to frame 1, either as illustrated in FIG. 1 or with the wall 15 closer to the hole 6 than the other end of the element 4. With respect to the specific dimensions of the embodiment illustrated in FIGS. 1 and 2, it has been found that pegs 7 and 10 may preferably be tapered at an angle of 4° with the length of the peg approximately 1 ⅝" and with its large end 17/32" in diameter. In such an arrangement the frame 1 may be approximately ¾" thick.

Figure 3:
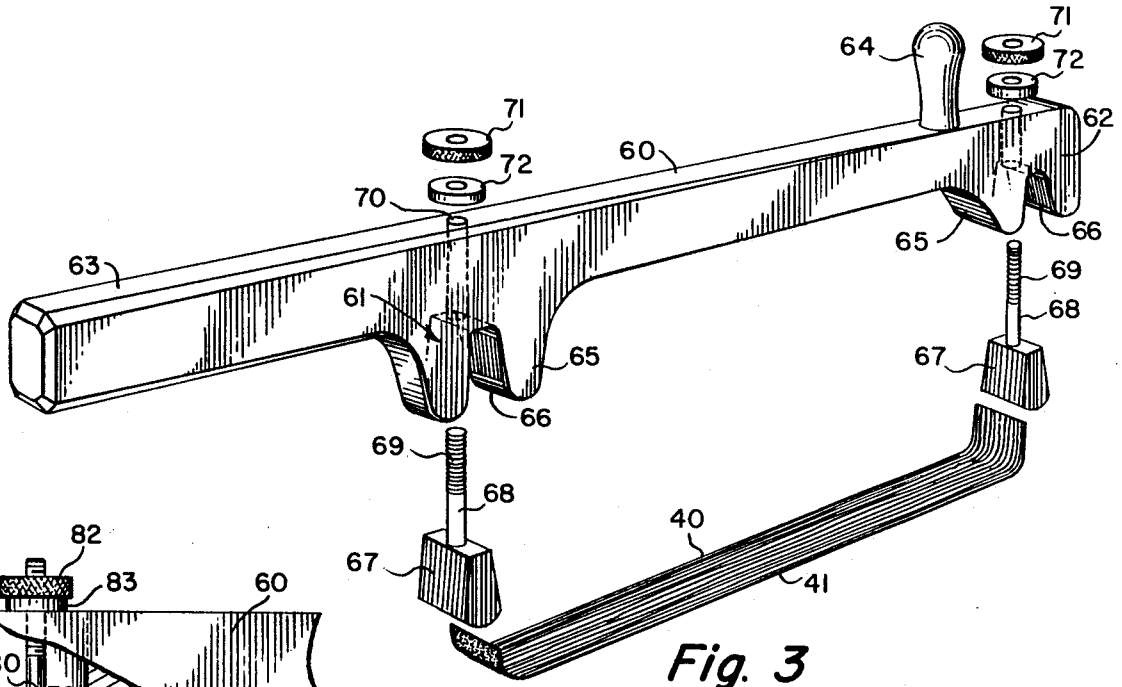
FIG. 3 is an exploded perspective view of a modification of the invention.

Another embodiment of the present invention is illustrated in FIG. 3. In this arrangement the frame 60 is formed with strip-engaging members 61 and 62, a handle 63 for one hand. A second handle 64 may be provided extending upwardly from the frame 60 at the end opposite the end from which handle 63 extends. In this arrangement each of the strip engaging members 61 and 62 is formed with a downwardly extending projection 65 having a V-shaped groove 66 formed in projection 65. In place of pegs a wedge 67, supported at the end of a shaft 68 having a threaded end 69, is shaped to provide a snug engaging fit between the wedge 67 and the side walls of the V shaped slot or groove 66. The shaft 68 projects upwardly through a hole 70 in the frame and is secured to it by nut 71 which bears on a washer 72 and threads onto the threaded end 69 for adjusting the engagement of the wedge with the sides of the slot 66.

A strip similar to that illustrated in FIG. 5 has each end extending to a side of the wedges 67 within the slots 66 and each is secured thereto by tightening the nut 71.

The adjacent corner of the groove 66 is rounded, which permits the clamping action of the wedge 67 against the abrasive strip and further permits the strip to be drawn into the clamp area and tightened.

In this arrangement the wedges may be made of metal, plastic or wood, as may be the other components of the embodiment illustrated in FIG. 3. Additionally in this arrangement the wedges and the strip engaging members 61 and 62 may be made wider than the main portions of the frame 60 in order to accommodate wider strips and to permit use of the tool with wider workpieces. In this embodiment, as in the embodiment illustrated in FIGS. 1 and 2, the clamping action between the wedge 67 and slot or groove 66 is enhanced by the presence of the abrasive material, preventing inadvertent slipping.

Figure 4:
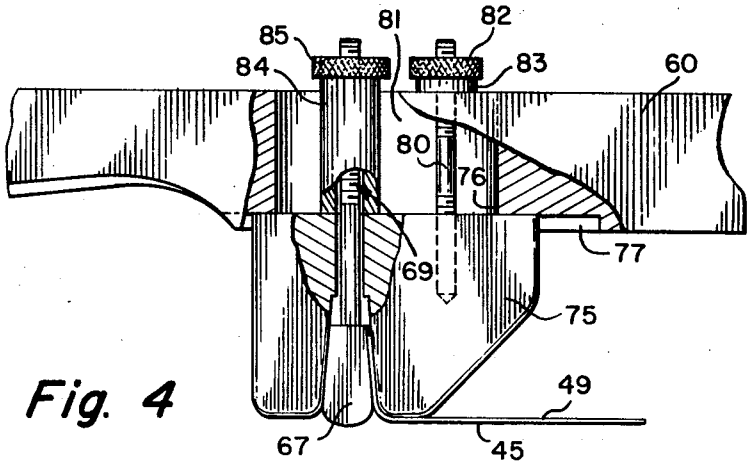
FIG. 4 is a fragmentary elevational view of a further modification of the invention.

The embodiments of FIG. 3 may also be modified to permit its use in a tool having an adjustable working length. In this modification illustrated in FIG. 4, the strip engaging member 75 may be at either end of the tool or frame 60. In this arrangement the member 75 is formed with an upper surface 76 that is adapted to slide longitudinally in an elongated slot 77 in the bottom surface of the frame 60. The member 75 is locked in a given position to the frame 60 and is secured in the slot 77 by a screw 80 which extends upwardly through an elongated slot 81 in the frame 60, with the screw 80 secured to a washer 83 and nut 82 at its upper end, and by the screw 80 threaded into the member 75 at its lower end. The wedge 67 is secured in the slot 66 of member 75 by the shaft 68 having the threaded end 69. However, in this configuration the threaded end 69 of the shaft 68 extends through a sleeve 84 that is locked by the nut 85. Sleeve 84 is free to slide longitudinally in slot 81.

It is intended that all matter contained in the above-description and shown in the accompanying drawings shall be interpreted in an illustrative and not in a limiting sense.

What is claimed is:

1. A hand sander comprising, an elongated C-shaped frame having opposed ends, an elongated strip including a flexible sheet coated on one side with abrasive particles and a enforcing sheet laminated to the other side of said flexible sheet, and means securing the ends of the strip one each to said C-shaped frame ends with the intermediate portion of said strip spaced from said C-shaped frame, wherein said means for securing ends of said strip to said C-shaped frame ends comprises a pair of tapered pegs and means forming a pair of tapered holes, one in each of said ends to receive said pair of tapered pegs with one end of said elongated strip second between each of said pegs and each cf said tapered holes.

2. A hand sander comprising a C-shaped frame having opposed ends, and means associated with each end for securing an end of a flexible abrasive strip to each of said opposed ends including a pair of mating grooves, one located at each of said opposed ends, and a pair of wedges adapted to engage and adjustably clamp each end of said strip between one of said wedges and one of said meting grooves.

* * * * *